US009073321B1

(12) United States Patent
Redding et al.

(10) Patent No.: US 9,073,321 B1
(45) Date of Patent: Jul. 7, 2015

(54) PRINTHEAD LAYER DESIGN FOR COMPATIBILITY WITH WET ADHESIVE APPLICATION PROCESSES

(71) Applicant: XEROX CORPORATION, Norwalk, CT (US)

(72) Inventors: Gary D. Redding, Victor, NY (US); Mark A. Cellura, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/211,422

(22) Filed: Mar. 14, 2014

(51) Int. Cl.
*B41J 2/045* (2006.01)
*B41J 2/14* (2006.01)
*B41J 2/16* (2006.01)

(52) U.S. Cl.
CPC ..... *B41J 2/14274* (2013.01); *B41J 2/14233* (2013.01); *B41J 2/1433* (2013.01); *B41J 2/14427* (2013.01); *B41J 2/1623* (2013.01)

(58) Field of Classification Search
CPC .. B41J 2/14427; B41J 2/1623; B41J 2/14233; B41J 2/14274; B41J 2/1433
USPC ..... 347/20, 45, 47, 54, 56, 68, 70, 71
See application file for complete search history.

(56) References Cited

U.S. PATENT DOCUMENTS

| | | | | |
|---|---|---|---|---|
| 7,794,056 | B2 * | 9/2010 | McAvoy et al. | 347/56 |
| 7,810,913 | B2 * | 10/2010 | Furukawa | 347/68 |
| 8,083,331 | B2 * | 12/2011 | Isono | 347/72 |
| 8,128,199 | B2 * | 3/2012 | Osaki | 347/40 |

* cited by examiner

*Primary Examiner* — An Do
(74) *Attorney, Agent, or Firm* — MH2 Technology Law Group LLP

(57) ABSTRACT

The printhead can include a nonwebbed diaphragm layer, an aperture plate layer, and a first webbed layer and a second webbed layer interposed between the diaphragm layer and the aperture plate layer. The nonwebbed diaphragm layer can be configured to deflect and eject ink from the print head during printing. The aperture plate layer can include a plurality of nozzles from which ink is ejected during printing. Each of the first and second webbed layers can include a first surface having a first surface area and comprising a plurality of first openings, a second surface opposing the first surface and comprising a plurality of second openings, and a web comprising a portion of the first surface, a portion of the second surface and a plurality of holes extending between the plurality of first and second openings. The printhead can be formed, in part, of alternating webbed and adjacent nonwebbed layers.

20 Claims, 9 Drawing Sheets

PRINTHEAD LAYER DESIGN FOR COMPATIBILITY WITH WET ADHESIVE APPLICATION PROCESSES

FIELD

Embodiments described herein relate generally to the field of printing, particularly ink jet printing, and specifically to the field of ink jet print head design and manufacturing.

BACKGROUND

In a conventional inkjet printer, a printhead can include a series of actuators for ejecting ink onto a substrate. Conventional actuator-based inkjet printers can rely on a multi-step process for jetting. For example, ink is drawn into an ejection chamber where a membrane (also referred to as a diaphragm) is pushed/pulled by the actuator and creates a pressure wave which forces the ink to move. That is, ink is ejected from an actuator nozzle when the diaphragm is released. The printhead can be formed of multiple individual layers, sometimes referred to individually as layers or plates (which can be metal and/or polymer). The plates/layers can be assembled together such as by stacking one plate over the other. The stacked plates/layers form what is referred to as a jetstack.

The jetstack can include internal fluid flow paths/channels through which ink from can flow and be jetted out of the printhead through an aperture plate. One of the plates/layers making up the printhead functions as a particulate filter, and can be a rock screen to protect a jetstack from contamination. Other plates can be designed with particular geometries for maintaining a predetermined ink volume throughout the printhead, and/or directing the flow of ink. For example, in order to properly direct the ink to the ejection chamber, and then from the ejection chamber to the aperture plate, the various jetstack layers may have ink flow holes that, when the layers are stacked one on top of the other, provide fluidic communication between the corresponding openings of adjacent plates, and form a complete fluid path for the ink. The size, geometry and order of the various plates in the jet stack can be limited by the allocated area of the printhead and pressure drop requirements for properly ejecting the ink.

One known method for assembling the various metal layers of a solid ink printhead is to stack them, and then place the stacked layers in a high temperature vacuum furnace while applying pressure to form a diffusion bond between the various metal plates. An advantage of this method is that several layers can be bonded simultaneously. However, this assembly method suffers from a cost disadvantage, in that the individual plates are often plated with a precious metal such as gold to improve the diffusion bond.

Another known assembly method is used for bonding individual layers, such as metal and/or polyimide layers, making up the print head. For example, such layers can be bonded using preformed thin film polymer adhesives that are designed and laser cut to match fine features/geometries of the layers the adhesives are formed between. While the use of polymer adhesive layers can reduce the cost, thin film plastics can be difficult to work with as they are not dimensionally as stable as metal plates, especially under high temperature and pressure. Additionally, moisture take-up/loss can cause dimensional instabilities and thin film polymer adhesives are also flimsy which makes them difficult to align fine features to one another. Finally use of polyimide plates are more prone to carrying contamination from the laser cutting process, and collecting new contamination particles as they have a tendency to generate an electrostatic charge.

In yet other assembly methods, some of the layers used for forming a print head can be stacked and bonded sequentially, or they may be stacked sequentially and then bonded simultaneously. In even yet another assembly method, some layers may be stacked and bonded to one another first and then bonded to another set of layers that were also stacked and bonded. In such a method, those layers that are bonded to one another with higher cure temperature adhesives are required to be bonded first to one another before subsequent layers bonded with lower temperature adhesive are added thereto.

For example, a conventional printhead jetstack 100, such as that shown in FIG. 1, can include a plurality of stacked layers/plates. The plurality of stacked layers/plates can include a diaphragm layer 102, a body plate 104, a vertical inlet 106, a rockscreen 108, a first manifold 110, a second manifold 112, and an aperture plate 137. Body plate 104 can be configured to define an ink chamber (as well as its volume) from which ink is ejected. Vertical inlet 106 can be configured to allow filtered ink into a body chamber (a smaller opening in the body plate) and also is configured to define a starting point (a larger opening in the body plate) of an exit path for the expelled ink. Rockscreen 108 can be configured to filter potentially problematic particulates, such as those capable of blocking or occluding the various ink flow pathways, from the ink. Manifolds 110 and 112 can be configured with a shared reservoir that feeds several individual body chambers of the print head. The jetstack can utilize additional layers/plates, for example, to provide for actuation and/or support to the printhead, such as a flex insulator layer 131, a flex metal 132, another flex insulator 133, an actuator 134, and a thermoplastic adhesive 136.

As described above, in a process for forming the jetstack, some of the plates, such as plates/layers 104, 106 and 108, may be assembled via a diffusion bonding process, wherein each plate is stacked, one on the other, and then diffusion bonded together. That is, one layer, such as body plate 104, can be diffusion bonded to vertical inlet 106, and separately, or in succession, rockscreen 108 can be diffusion bonded to vertical inlet 106. Additionally, diaphragm layer 102 can be diffusion bonded to body plate 104. Upon bonding the layers as described, portions of their individual geometries match-up with those of adjacent layers/plates to form an ink flow path.

It is desirable to reduce the manufacturing costs associated with stacking the layers of a conventional jetstack. As discussed above, one way to reduce the cost is to eliminate the need for diffusion bonding, which relies on the use of precious metals, and use an alternative method for bonding the conventional layers/plates. For example, instead of diffusion bonding the metal plates, they can each be adhesive bonded to an adjacent plate, wherein adhesive is added via spray coating, as is the case for bonding webbed first manifold layer 110 to rock screen 108. However, at least conventional body plate 104, vertical inlet 106 and rockscreen 108 lack appropriate geometries for moving to a process that utilizes only adhesive bonding, even in the case in which it is important that a very thin layer of adhesive be formed on the layers being bonded via adhesive bonding. That is, without the correct geometry, when such layers/plates are placed together for adhesive bonding, excessive adhesive will flow (squeeze-out) from between the layers and flow into the designed ink path, restricting or completely blocking the flow of ink.

While not limited to any particular theory, it is believed that upon the various conventionally designed plates being stacked together, adhesive will tend to accumulate in voids formed on each plate, such as a plate's ink-flow holes. This is due to the active area of geometries of such conventional plates/layers including large surface area of continuous surface surrounding ink-flow holes having a smaller relative area. As shown in FIGS. 2A-2B, the conventional diaphragm includes a surface 101 that includes an active area 103. The active area 103 can include a plurality of ink flow holes 103', with each ink flow hole 103' separated by solid surface 101'. As illustrated, not only does the diaphragm's surface comprise a much larger area of the total plate than does the active area, but also the solid surface 101' comprises a larger area of the active area 103 than do the plurality of ink flow holes 103'. Thus, upon bonding the diaphragm to another conventionally designed layer, such as to a first surface of body layer 104, adhesive is forced into the ink flow paths 103' as shown by the adhesive obstructions 115, which can be detrimental to the printhead's normal function.

Another problem can occur when adhesive being added to a layer in which the ink flow holes are too small, such as on a conventional vertical inlet layer 106. In such a case, there is a risk that adhesive will fill the ink flow holes while applying/spraying on the adhesive before bonding. For example, as shown in FIGS. 3A-3B, the vertical inlet layer 106 can include a surface 107 of which a portion is an active area 105. The active area 105 can include a plurality of ink flow outlet holes 105', a plurality of inlet holes 139, and a solid surface 107' that separates the various ink flow holes 137, 139. Additionally, vertical inlet 106 can include large thru ink feeds 135 that provide an ink flow path from one section of the printhead (e.g., a back section or the top of the printhead in FIG. 1) to another section of the printhead (e.g., a front section or the bottom of the printhead in FIG. 1 where the vertical inlet is fluidically connected to finger manifolds formed by the plates of manifolds 110 and 112). Accordingly, an ink flow path is formed within the jetstack that can be blocked by excess adhesive formed between the layers of the stack. For example, the ink flow path can extend from from the finger manifolds of manifolds 110 and 112 through the rockscreen and through the plurality of smaller openings 139. Upon activation of the piezoelectric actuator 134, ink is forced through the ink flow path that continues from the body chamber through the plurality of larger ink flow holes 105' of the vertical inlet plate, through a non-reservoir portion of manifold plates 110 and 112, through ink flow openings of a compliant wall 136 and through ink flow openings of a thermoplastic adhesive that is disposed between the compliant wall 136 and aperture plate 137. However, as shown, the active area surface 107' between i) adjacent ones of holes 105', ii) adjacent holes 105' and 139, and iii) adjacent ones of holes 139, has a larger area than the areas of the flow holes. Thus, upon bonding the diaphragm to another conventionally designed layer, such as at a second surface of body layer 104, adhesive can flow into the ink flow holes 105' and 139', which can be detrimental to the printhead's normal function.

What is needed, therefore, is a method for assembling a printhead that minimizes or eliminates use of diffusion bonding of jetstack plates or use of preformed adhesive films for bonding layers of a jetstack together.

SUMMARY

In an embodiment, there is a printhead that can include a nonwebbed (NW) diaphragm layer, an aperture plate layer, at least one of a first webbed (W) layer interposed between the diaphragm layer and the aperture plate layer, and at least one of a second webbed layer interposed between the diaphragm layer and the aperture plate layer. The nonwebbed diaphragm layer can be configured to deflect and eject ink from the print head during printing. The aperture plate layer can include a plurality of nozzles from which ink is ejected during printing. The at least one first webbed layer and the at least one second webbed layer can each include a first surface having a first surface area and comprising a plurality of first openings, a second surface opposing the first surface and comprising a plurality of second openings, and a web comprising a portion of the first surface, a portion of the second surface and a plurality of holes extending between the plurality of first and second openings. Each of the plurality of openings can include a cross-sectional area. A sum of the cross-sectional areas of the plurality of first openings can include more than about 35% of the first surface area, and a solid surface area of the web can include less than about 65% of the first surface area.

In another embodiment there is a method of manufacturing a printhead. The method can include providing a nonwebbed diaphragm layer, providing an aperture plate layer, providing at least one of a first webbed layer interposed between the diaphragm layer and the aperture plate layer, and providing at least one of a second webbed layer interposed between the diaphragm layer and the aperture plate layer. The nonwebbed diaphragm layer can be configured to deflect and eject ink from the print head during printing. The aperture plate layer can include a plurality of nozzles from which ink is ejected during printing. The at least one first webbed layer and the at least one second webbed layer can each include a first surface having a first surface area and comprising a plurality of first openings, a second surface opposing the first surface and comprising a plurality of second openings, and a web comprising a portion of the first surface, a portion of the second surface and a plurality of holes extending between the plurality of first and second openings. Each of the plurality of openings can include a cross-sectional area. A sum of the cross-sectional areas of the plurality of first openings can include more than about 35% of the first surface area, and the web can include less than about 65% of the first surface area.

Advantages of at least one embodiment include a printhead fabrication method that allows the use of thin metal plates without the need for a costly, high temperature, deep-vacuum diffusion bond. An advantage of at least one embodiment includes a manufacturing process compatible with the use of wet adhesive application processes for forming a jetstack.

Additional advantages of the embodiments will be set forth in part in the description which follows, and in part will be understood from the description, or may be learned by practice of the embodiments. The advantages will be realized and attained by means of the elements and combinations particularly pointed out in the appended claims.

It is to be understood that both the foregoing general description and the following detailed description are exemplary and explanatory only and are not restrictive of the embodiments, as claimed.

The accompanying drawings, which are incorporated in and constitute a part of this specification, illustrate embodiments and together with the description, serve to explain the principles of the embodiments.

DESCRIPTION OF THE EMBODIMENTS

Figure 1:
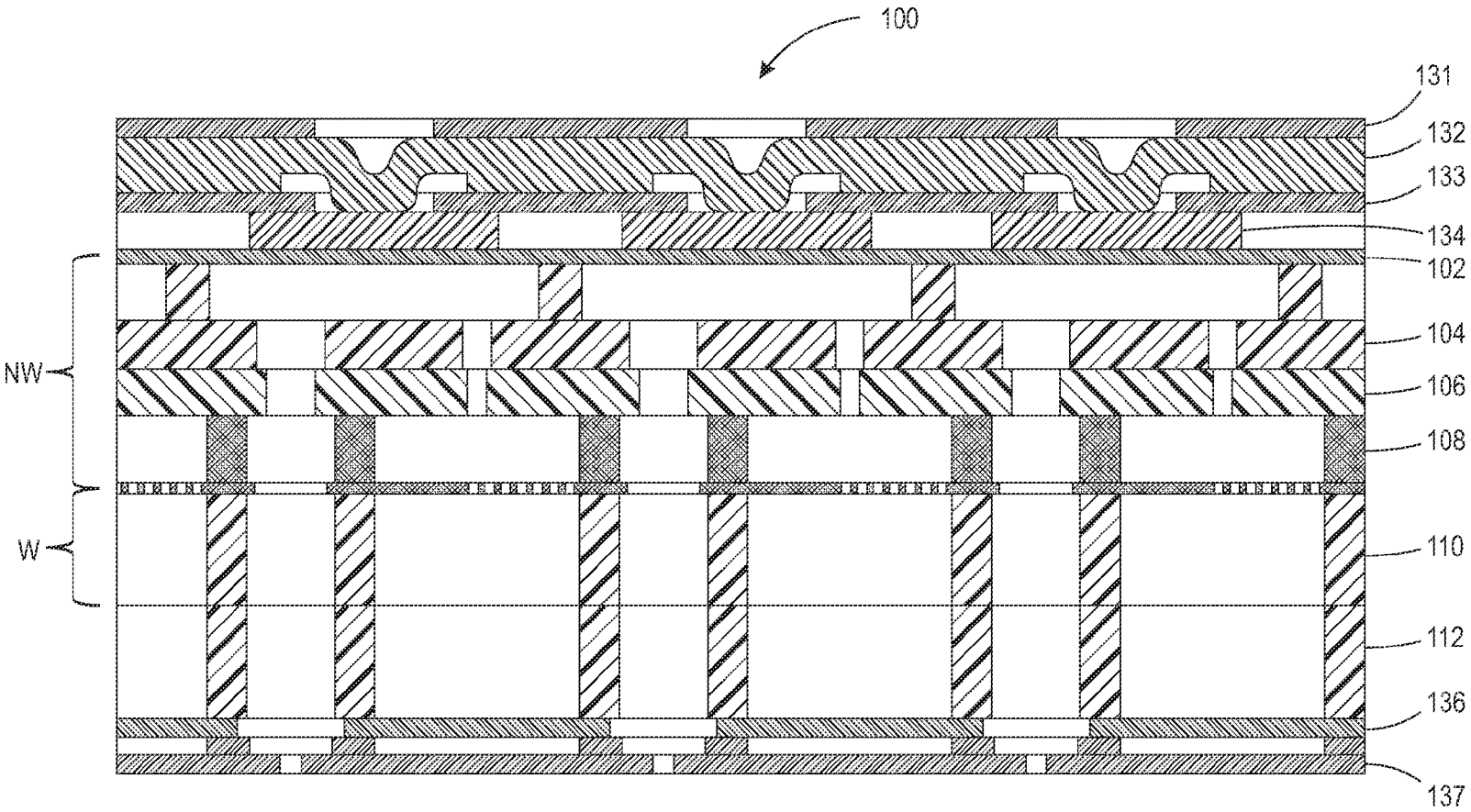
FIG. 1 illustrates a cross-sectional view of a conventional printhead jetstack.
Figure 2A:
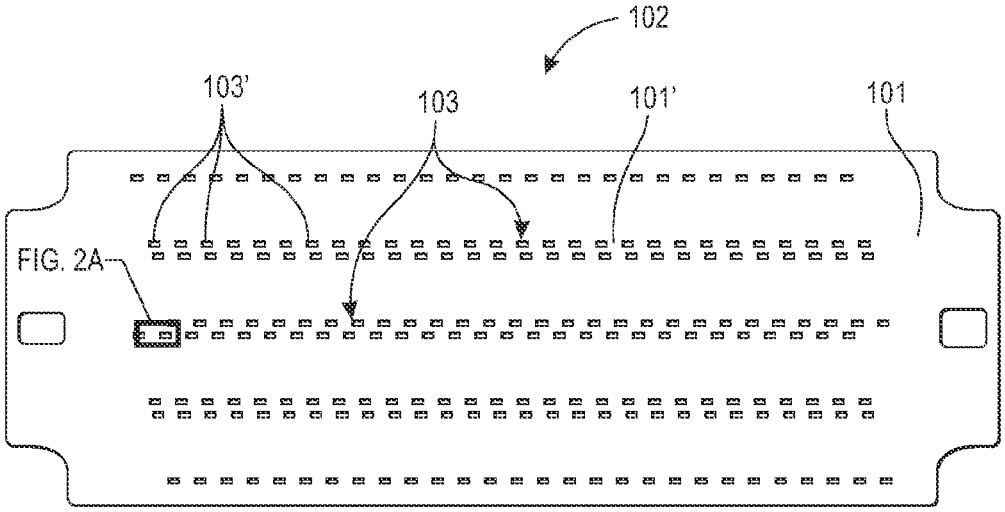
FIG. 2A is a top view of a conventional nonwebbed diaphragm layer as removed from a jetstack for which assembly included adhesive bonding between the diaphragm layer and an adjacent nonwebbed layer.
Figure 2B:
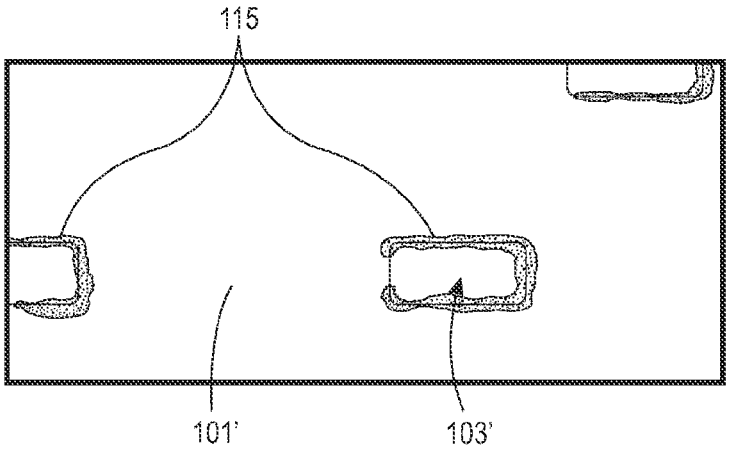
FIG. 2B is representation of a micrograph taken of a plate, such as the conventional diaphragm layer shown in FIG. 2A, and showing post-adhesive bonding effects on the plate.
Figure 3A:
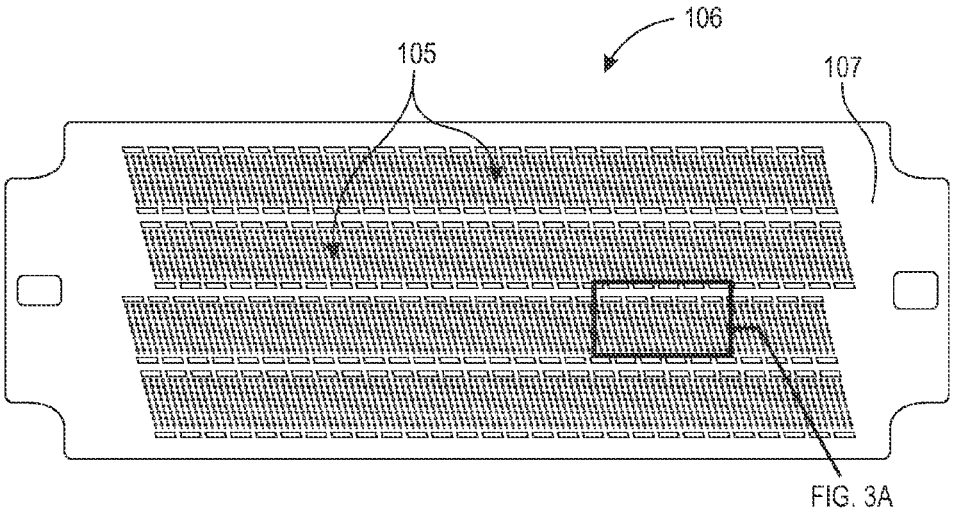
FIG. 3A is a perspective view of a conventional, nonwebbed vertical inlet layer of a jetstack.
Figure 3B:
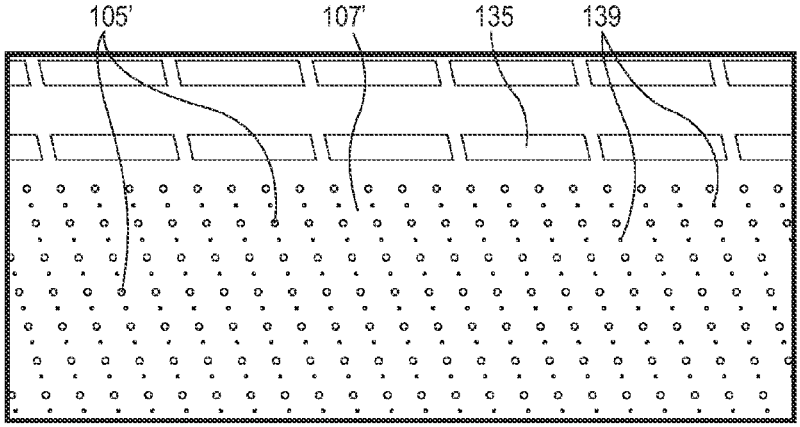
FIG. 3B is a close-up view of the nonwebbed vertical inlet layer of FIG. 3A.

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

The following embodiments are described for illustrative purposes only with reference to the figures. Those of skill in the art will appreciate that the following description is exemplary in nature, and that various modifications to the parameters set forth herein could be made without departing from the scope of the present embodiments. It is intended that the specification and examples be considered as examples only. The various embodiments are not necessarily mutually exclusive, as some embodiments can be combined with one or more other embodiments to form new embodiments.

Embodiments disclosed herein are directed to, but not limited to, a printhead and a corresponding printhead fabrication method that provides for the use of thin metal layers/plates without the need for a costly, high temperature, low vacuum diffusion bond formed between adjacent layers/plates of a jetstack.

As used herein, the term "webbed", "webbed layer", "layer that is webbed" is directed to jetstack layers comprising designs having a portion, for example, a majority, of their active region formed as web of thin walls separating a plurality of openings. As an example, a webbed layer can include thin walls that provide upper surfaces having a large enough surface area on which adequate amounts of adhesive can be coated. As such, when the webbed layer is bonded to a subsequent plate in a stacking process, there is enough adhesive on the webbed portion to allow for formation of a liquid seal between stacked plates, such as a liquid seal at least around ink flow holes of the plates. The webbed portions surface area is also minimized to prevent excessive capture of sprayed adhesive that would otherwise accumulate and flow into undesired locations of the plate, such as the ink flow holes, when bonded to another plate. In other words, a given layer of a jetstack provided with a webbed geometry has a large enough surface area to capture an amount of sprayed material, such as adhesive, and allow the sprayed material to form a fluid seal when the layer is placed in contact with an adjacent layer in a jetstack. However, the webbed geometry does not have so much surface area that excess sprayed material accumulates thereon and, as a result, squeezes into ink flow path openings when the layers are placed in contact with one another.

Figure 4:
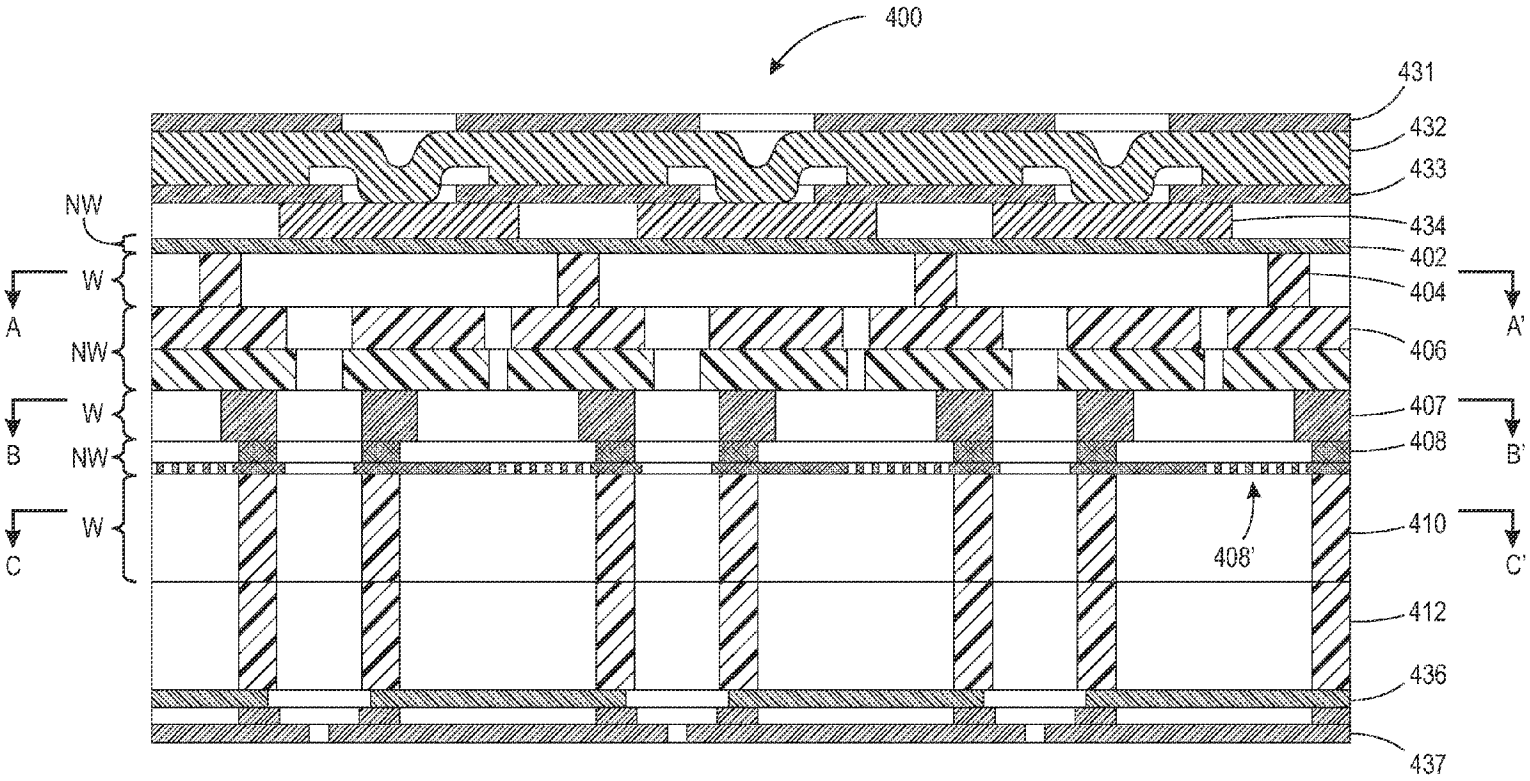
FIG. 4 is a cross-sectional view of a jetstack of an embodiment.

Accordingly, as shown in FIG. 4, an embodiment includes a jetstack 400 of a printhead comprising webbed (W) and nonwebbed (NW) plates. The webbed plates can include geometries, discussed below, that allow for being adhesive-bonded between other plates, such as between nonwebbed plates, and avoid ink flow hole obstruction problems associated with adhesive bonding of conventional plates.

In other words, there is a printhead that can include a nonwebbed diaphragm layer 402 configured to deflect and eject ink from the printhead during printing, an aperture plate layer 437 that can include a plurality of nozzles from which ink is ejected during printing, and at least one of a first webbed layer interposed between the diaphragm layer 402 and the aperture plate layer 437, and at least one of a second webbed layer interposed between the diaphragm layer 402 and the aperture plate layer 437. The jetstack 400 can also include additional layers, such as a flex insulator 431, a flex metal layer 432, another flex insulator 433 and an actuator 434, such as a lead zirconate titante (PZT) actuator.

To be compatible with spray coating, some of the functionality and design features of a conventional body plate can instead be incorporated into a vertical inlet plate, thus providing nonwebbed vertical inlet 406. Meanwhile other features of a conventional body plate can remain in a webbed body plate 404. Additionally, functionality and design features of a conventional rockscreen can be removed therefrom, and instead incorporated into the design of a separate layer. Thus, the embodiment shown in FIG. 4, includes a webbed separator 407. Accordingly, the at least one first webbed layer and the at least one second webbed layer can be selected from a webbed body plate 404, a webbed manifold 410 and a third webbed layer, such as a webbed separator 407. One or more of the at least one first webbed layer and the at least one second webbed layer can have a thickness between the first surface and the second surface thereof in the range of about 25 μm to about 150 μm, for example from about 50 μm to about 100 μm.

The webbed plates/layers, such as the at least one first webbed layer and the at least one second webbed layer can each include a first surface having a first surface area and comprising a plurality of first openings, a second surface opposing the first surface and comprising a plurality of second openings, and a web comprising a portion of the first surface, a portion of the second surface and a plurality of holes extending between the plurality of first and second openings. The at least one first webbed layer and/or the at least one second webbed layer can be formed of a metal, such as stainless steel, electroformed nickel, molybdenum, or a polymer such as Acrylic Adhesive Films (e.g., ROGERS R1500 available from Rogers Corp. of Rogers, Conn.), Polyimide Films (e.g., UPILEX®-S available from UBE Industries, Ltd. of Tokyo, Japan), thermoplastics or thermosetting adhesives (e.g., DuPont ELJ-100 available from E.I. du Pont de Nemours of Wilmington, Del.).

The plurality of holes can have circular cross sections or polygonal cross sections. The plurality of holes can comprise holes having a uniform cross-section or holes having combinations of various cross-sections and/or of uniform cross sections. The plurality of holes can be arranged, for example, in a period array, and can be separated from one another by a first period in a first direction and a second period in a second direction. For example, the first direction can correspond to a length direction of the respective webbed layer and the second direction can correspond to a width direction of the webbed layer. Each of the plurality of openings can include a cross-sectional area which can correspond to the shape of a respective hole's cross section. A sum of the cross-sectional areas of the plurality of first openings can include more than about 35% of the first surface area, and a solid surface area of the web can include less than about 65% of the first surface area. In an embodiment, a sum of the cross-sectional areas of the plurality of first openings can include more than about 50% of the first surface area, and a solid surface area of the web can include less than about 50% of the first surface area. In an embodiment a sum of the cross-sectional areas of the plurality of first openings can include more than about 85% of the first surface area, and a solid surface area of the web can include less than about 15% of the first surface area.

The web can further include a plurality of sidewalls, each of which surrounds a respective one of the plurality of holes. Thus, adjacent ones of the plurality of sidewalls can be separated by at least one of a major separation distance from about 100 μm to about 2500 μm and a minor separation distance from about 50 μm to about 800 μm.

It is, therefore, possible to provide jetstack 400 having a first nonwebbed plate/layer, such as a fluid channeling layer, interposed between the first webbed (W) plate/layer and the second webbed (W) plate/layer, with adhesive formed between the first webbed plate/layer and the nonwebbed plate/layer, and adhesive formed between the nonwebbed plate/layer and the second webbed plate/layer. In other words, jetstack 400 can include adhesive formed between at least one of the diaphragm layer 402 and a first webbed layer's first surface.

For example, adhesive can be formed on a first surface of webbed body plate 404 to which diaphragm layer 402 is bonded. Additionally, adhesive can be formed between the first webbed layer's second surface and a first surface of a first fluid channeling layer. For example, adhesive can be formed on a second surface of webbed body plate 404 to which a first surface of nonwebbed vertical inlet 406 is bonded. Meanwhile, adhesive can be formed on a second surface of the fluid channeling layer and the second webbed layer's first surface. For example, adhesive can be formed on a first surface of webbed separator 407 to which a second surface of nonwebbed vertical inlet 406 is bonded. Also, adhesive can be formed between the second webbed layer's second surface and the aperture layer, such as between the second webbed layer's second surface and a first surface of a second fluid channeling layer/plate. For example, adhesive can be formed on a second surface of webbed separator 407 to which a first surface of rockscreen (or "pocketed filter") 408 is bonded. In addition, adhesive can be formed between a second surface of the fluid channeling layer and a first surface of a third webbed layer. For example, adhesive can be formed on a first surface of a webbed manifold 410 to which a second surface, such as on a jetting side 408', of rockscreen 408 is bonded. Finally, adhesive can be formed between the third webbed layer's second surface and the aperture layer, such as between the third webbed layer's second surface and a first surface of a third fluid channeling layer. For example, adhesive can be formed on a second surface of webbed manifold 410 to which a first surface of manifold 412 is bonded.

The adhesive formed on surfaces of the at least one first webbed layer and the at least one second webbed layer can be, for example, adhesive model no. 12300 available from Resin Designs (Woburn, Mass.).

Figure 5A:
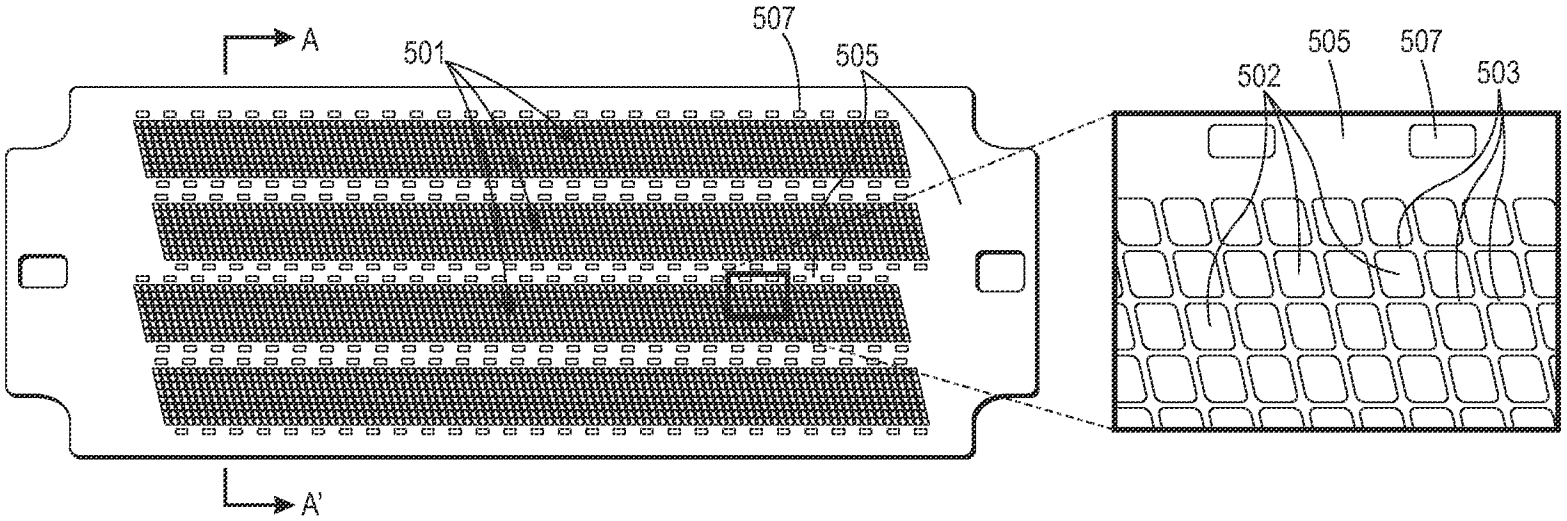
FIG. 5A is a top-view of a webbed body plate embodiment as viewed according to cut through A-A' of FIG. 4, and including an inset showing a close-up view of the webbed body plate's web.

In an embodiment, the at least one first webbed layer and the at least one second webbed layer can comprise a webbed body plate, such as the webbed body plate illustrated in FIG. 5A. Webbed body plate 404 can include one or more of the features described above for the at least one first webbed layer and the at least one second webbed layer, as well as additional, fewer and/or different features. For example, webbed body plate 404 can include a first surface 505 having a first surface area and comprising a plurality of first openings, a second surface (not visible) opposing the first surface and comprising a plurality of second openings, and a web 501 comprising a webbed portion 503 of the first surface 505, a webbed portion (not visible) of the second surface and a plurality of holes 502 extending between the plurality of first and second openings. In an embodiment, the first and second surfaces are identical and plate material extends from the webbed portion 503 of the first surface to the webbed portion of the second surface to form sidewalls that separate the holes 502. Each of the first and second openings to which corresponding holes 502 extend, can include an associated cross-sectional area. A sum of the cross-sectional areas of the plurality of first openings corresponding to holes 502 can include more than 50% of the first surface area, and a solid surface area of the web can include less than 50% of the first surface area. Accordingly, adhesive can be added to the webbed portion 503 of the first surface (as well as webbed portion of the second surface which is not visible) on the webbed body plate 404 to adhesively bond the body plate to other layers/plates of the stack 400 as shown in FIG. 4 while preventing adhesive from obstructing ink flow holes 507 of the webbed body plate.

Figure 5B:
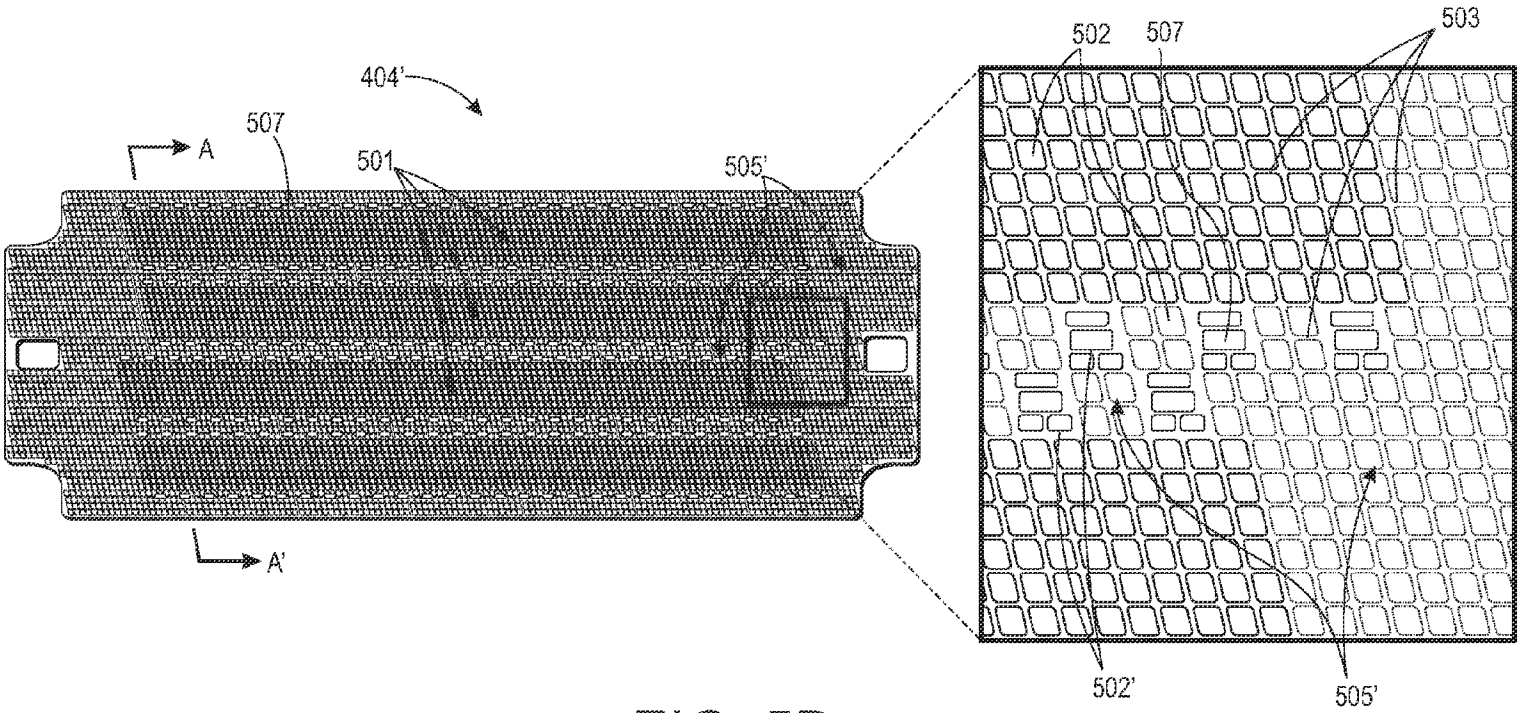
FIG. 5B illustrates a top view of an alternate embodiment of a webbed body plate, such as an alternate embodiment of the webbed body plate shown in FIG. 5A, including an inset showing a close-up view of the alternate webbed body plate's web. A web of the alternate body plate covers a larger surface as compared to the web of FIG. 5A is illustrated.

In an embodiment, the at least one first webbed layer and the at least one second webbed layer can comprise an alternate design for a webbed body plate, such as the alternate webbed body plate 404' illustrated in FIG. 5B. Alternate webbed body plate 404' can include one or more of the features described above for the at least one first webbed layer and the at least one second webbed layer, as well as additional, fewer and/or different features. For example, alternate webbed body plate 404' include a first surface 505' having a first surface area and comprising a plurality of first openings, a second surface (not visible) opposing the first surface and comprising a plurality of second openings, and a web 501 comprising a webbed portion 503 of the first surface 505', a webbed portion (not visible) of the second surface and a plurality of holes 502 as well as alternate web openings 502' (having the same or different cross-sectional area as holes 502) extending between the plurality of first and second openings. In an embodiment, the first and second surfaces of alternate webbed body plate 404' can be identical with the material forming the plate extending from the webbed portion 503 of the first surface to the webbed portion of the second surface to form sidewalls that separate the holes 502. Each of the first and second openings to which corresponding holes 502 extend, can include an associated cross-sectional area. A sum of the cross-sectional areas of the plurality of first openings such as openings 502' and/or those openings corresponding to holes 502 can include more than about 85% of the first surface area, and a solid surface area of the web, for example, corresponding to the surface 503, can include less than about 15% of the first surface area. Accordingly, adhesive can be added to the webbed portion 503 of the first surface (as well as webbed portion of the second surface which is not visible) on the webbed body plate 404 to adhesively bond the body plate to other layers/plates of the stack 400 as shown in FIG. 4 while preventing adhesive from obstructing ink flow holes 507 of the webbed body plate.

Figure 6:
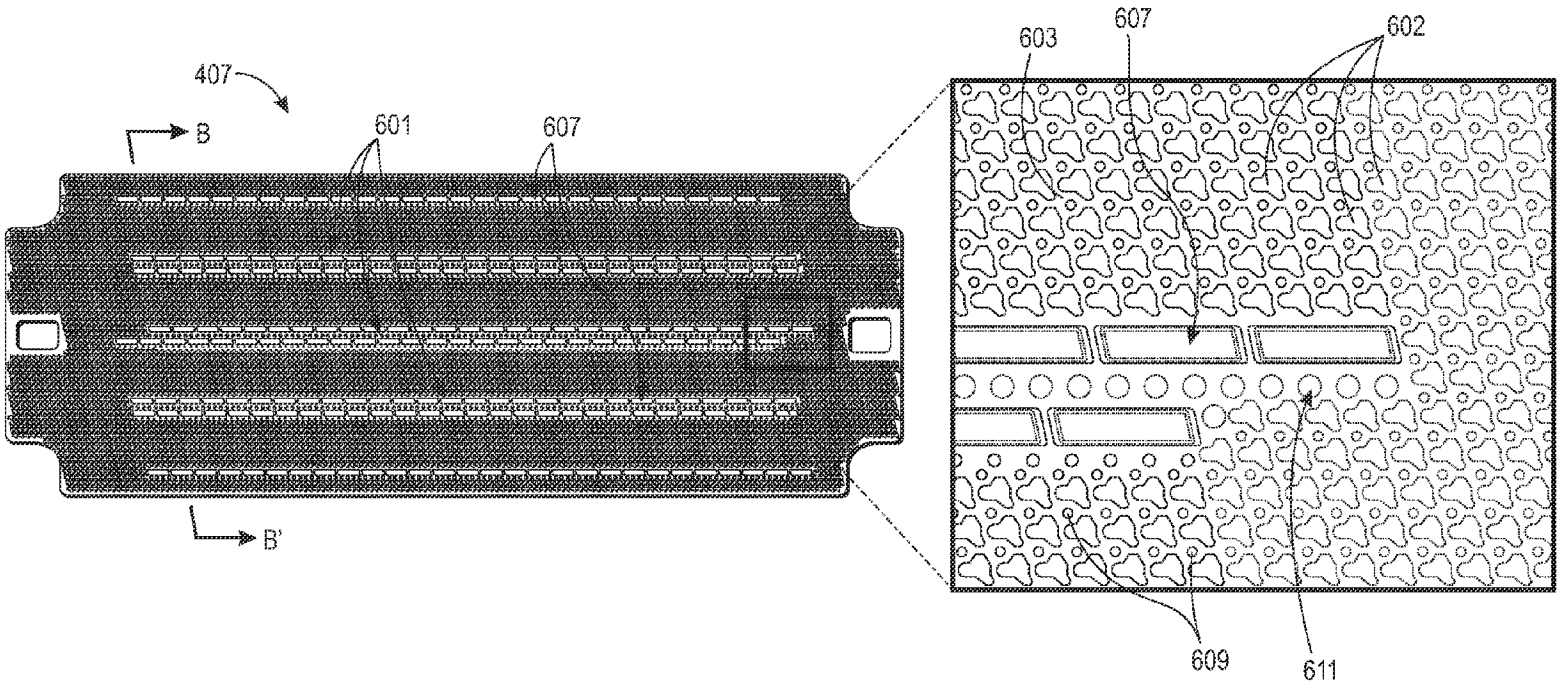
FIG. 6 is a top-view of a webbed separator plate embodiment as viewed according to cut through B-B' of FIG. 4.

In an embodiment, the at least one first webbed layer and the at least one second webbed layer can comprise a webbed separator 407, such as the webbed separator 407 illustrated in FIG. 6. Webbed separator 407 can include one or more of the features described above for the at least one first webbed layer and the at least one second webbed layer, as well as additional, fewer and/or different features. For example, webbed separator 407 can include a first surface having a first surface area and comprising a plurality of first openings, a second surface (not visible) opposing the first surface and comprising a plurality of second openings, and a web 601 comprising a webbed portion 603 of the first surface, a webbed portion (not visible) of the second surface and a plurality of holes 602 extending between the plurality of first and second openings. In an embodiment, the first and second surfaces are identical and plate material extends from the webbed portion 603 of the first surface to the webbed portion of the second surface to form sidewalls that separate the holes 602. Each of the first and second openings, to which corresponding holes 602 extend, can include an associated cross-sectional area. A sum of the cross-sectional areas of the plurality of first openings can include more than about 35% of the first surface area, and a solid surface area of web, for example, corresponding to the surface of webbed portion 603, can include less than about 65% of the first surface area. Accordingly, adhesive can be added to the webbed portion 603 of the first surface (as well as webbed portion of the second surface which is not visible) on the webbed separator plate 407 to adhesively bond the separator plate to other layers/plates of the stack 400 as shown in FIG. 4, while preventing adhesive from obstructing ink flow holes 607 of the webbed separator.

Figure 7:
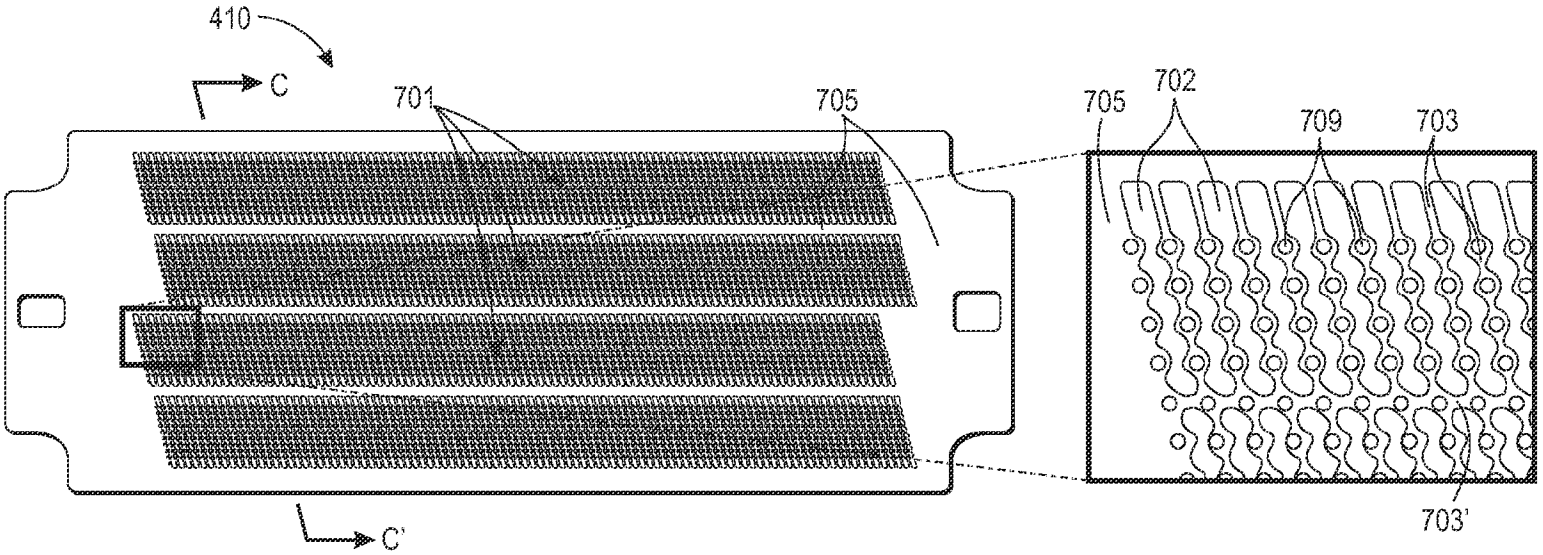
FIG. 7 is a top-view of a webbed manifold plate as viewed according to cut-through C-C' of FIG. 4, and including an inset showing a close-up view of the webbed manifold's web.

In an embodiment, the at least one first webbed layer and the at least one second webbed layer can comprise a webbed manifold 410, such as the webbed manifold 410 illustrated in FIG. 7. Webbed manifold 410 can include one or more of the features described above for the at least one first webbed layer and the at least one second webbed layer, as well as additional, fewer and/or different features. For example, webbed manifold 410 can include a first surface 705 having a first surface area and comprising a plurality of first openings, a second surface (not visible) opposing the first surface and comprising a plurality of second openings, and a web 701 comprising a webbed portion 703 of the first surface, a webbed portion (not visible) of the second surface, and a plurality of holes 702 extending between the plurality of first and second openings. In an embodiment, the first and second surfaces are identical and plate material extends from the webbed portion 703 of the first surface to the webbed portion of the second surface to form sidewalls that separate the holes 702. Each of the first and second openings, to which corresponding holes 702 extend, can include an associated cross-sectional area. A sum of the cross-sectional areas of the plurality of first openings can include more than about 70% of the first surface area, and the web can include less than about 30% of the first surface area. Accordingly, adhesive can be added to the webbed portion 703 of the first surface (as well as webbed portion of the second surface which is not visible) on the webbed manifold plate 410 to adhesively bond the manifold plate to other layers/plates of the stack 400 as shown in FIG. 4, while preventing adhesive from obstructing ink flow holes 709 of the webbed separator.

EXAMPLES

Example 1

Spray Coating and Bonding

A wet adhesive can be mixed with a solvent and can be applied to certain preselected ones of the printhead layers, for example, preselected webbed layers of the printhead, by a method such as spray coating or pad printing. The solvent can then be allowed to evaporate away, leaving behind a thin film of slightly tacky adhesive on surface portions of the preselected metal plates. The plates can be aligned and stacked, for example, on a locating fixture, and bonded at low temperature such as a temperature in a range selected from about 320° F. to about 365° F., and a pressure, such as a pressure in a range selected from of about 70 psi to 150 psi.

Example 2

Adhesive Bonding Webbed and Nonwebbed Layers

A jetstack was assembled and then operated to investigate the quality of adhesive bonding between a webbed and nonwebbed layer. Assembly of the jetstack included spray coating an adhesive onto a surface of a webbed manifold layer, such as a first surface of webbed manifold layer 410, followed by bonding to a nonwebbed layer, such as rockscreen 408, according to the steps discussed in Example 1. Upon assembling the jetstack, it was incorporated into a print head which was operated to include enough use to thoroughly channel ink throughout the ink flow pattern of the jetstack.

Figure 8:
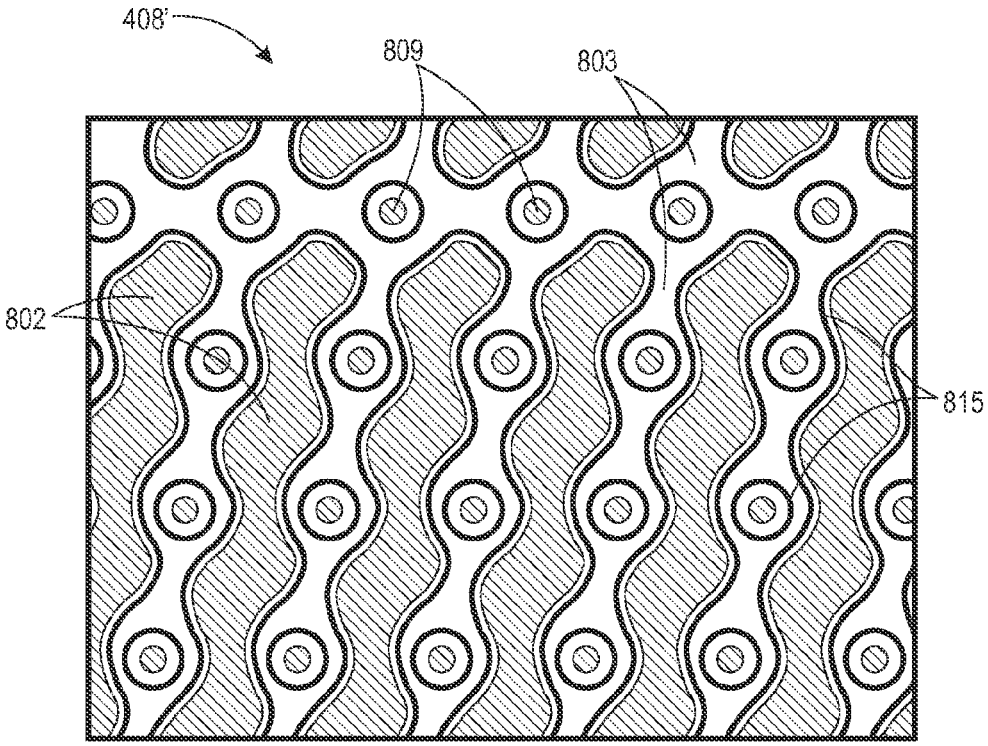
FIG. 8 is an underside close-up view (jetting side) of a rockscreen, such as a nonwebbed rockscreen in FIG. 4, upon examination after use and showing continuous beads/fillets of adhesive surrounding the silhouette's formed by contact with the webbed manifold's web.

An autopsy was performed to separate the various layers of the jetstack after operation of the printhead. Shown in FIG. 8 is an underside close-up view (jetting side) of a nonwebbed pocket filter/rockscreen that was previously adhesive-bonded to the webbed manifold but was since separated during the autopsy. The autopsy examination revealed fillet 815 of dried adhesive as a continuous bead surrounding silhouette's 803. The silhouette's 803 were formed during operation of the printhead as ink flowed to/from the rockscreen which died/darkened those portions of the jetting side of the rockscreen which the ink contacted. The shaded regions 802 and 809 correspond to ink flowing across portions of the rockscreen, while the silhouette's indicate that portions of the rockscreen were not penetrated by the ink. Accordingly, the continuous bead 815 as well as the appearance of silhouette's undisturbed by ink confirmed adequate seal was been made between the rockscreen and manifold layers.

While embodiments have been illustrated with respect to one or more implementations, alterations and/or modifications can be made to the illustrated examples without departing from the spirit and scope of the appended claims. In addition, while a particular feature of an embodiment may have been disclosed with respect to only one of several implementations, such feature may be combined with one or more other features of the other implementations as may be desired and advantageous for any given or particular function.

For example, a printhead of the embodiments can be formed, in part, via a sprayed adhesive process. That is, embodiments described herein provide a printhead, including a jetstack that can be constructed with alternating webbed layers that provide manufacturing compatibility with spray coating processes for providing adhesive between the various layers/plates of the jetstack. Although the embodiments may require the addition of an additional layer compared to the conventional jetstacks, the construction of printheads can be simplified accordingly. For example, by spray coating adhesive onto both sides of only three webbed layers (webbed body plate, webbed separator, webbed manifold) the majority of the jetstack, for example between the diaphragm and the manifold can be aligned and bonded in one single stack press operation. In other words, a print head assembly comprising a stack of alternating webbed and nonwebbed layers can be formed by stacking successive layers with the webbed layers being spray coated on opposing surfaces thereof with adhesive, with a subsequent bonding step that bonds the entire assembly in one step. In an embodiment, the spray-coated adhesive can air-dry, similar to a b-stage epoxy, and can be handled without smearing the adhesive.

Embodiments described herein can be incorporated into existing printhead designs for at least the reason that the ink fluid paths remain unchanged even though additional layers, such as additional webbed layers, can be incorporated to the jetstack to allow for a spray coating process to be adopted in the manufacturing process.

Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments will be apparent to those skilled in the art from consideration of the specification and practice of the embodiments disclosed herein. It is intended that the specification and examples be considered as exemplary only, with a true scope and spirit of the embodiments being indicated by the following claims.

What is claimed is:

1. A print head, comprising:

a nonwebbed diaphragm layer configured to deflect and eject ink from the print head during printing;

an aperture plate layer comprising a plurality of nozzles from which ink is ejected during printing; and each of a first webbed layer and a second webbed layer interposed between the diaphragm layer and the aperture plate layer;

wherein each of the first and the second webbed layers comprise a first surface having a first surface area and comprising a plurality of first openings;

a second surface opposing the first surface and comprising a plurality of second openings; and a web comprising a portion of the first surface, a portion of the second surface and a plurality of holes extending between the plurality of first and second openings, wherein each of the plurality of openings comprises a cross-sectional area, wherein a sum of the cross-sectional areas of the plurality of first openings comprises more than about 35% of the first surface area, and wherein a solid surface area of the web comprises less than about 65% of the first surface area.

2. The print head of claim 1, further comprising a first nonwebbed layer interposed between the first webbed layer and the second webbed layer, adhesive formed between the first webbed layer and the nonwebbed layer, and adhesive formed between the nonwebbed layer and the second webbed layer.

3. The print head of claim 1, wherein the web further comprises a plurality of sidewalls, each of which surrounds a respective one of the plurality of holes, wherein adjacent ones of the plurality of sidewalls are separated by at least one of a major separation distance from about 100 μm to about 2500 μm and a minor separation distance from about 50 μm to about 800 μm.

4. The print head of claim 1, wherein at least some of the plurality of holes comprise circular cross sections or polygonal cross sections.

5. The print head of claim 1, wherein the webbed layer has a thickness between the first surface and the second surface of about 25 μm to about 150 μm.

6. The print head of claim 1, wherein the holes are separated by a first period in a first direction and a second period in a second direction.

7. The print head of claim 6, wherein the first direction comprises a length direction of the webbed layer and the second direction comprises a width direction of the webbed layer.

8. The print head of claim 1, further comprising a fluid channeling layer formed between the first webbed layer and the second webbed layer.

9. The print head of claim 8, further comprising adhesive formed between at least one of the diaphragm layer and first webbed layer's first surface, the first webbed layer's second surface and a first surface of a first fluid channeling layer, a second surface of the fluid channeling layer and the second webbed layer's first surface, and the second webbed layer's second surface and the aperture layer.

10. The printhead of claim 1, further comprising a nonwebbed vertical inlet layer, a nonwebbed pocketed filter layer, and a third webbed layer, wherein the first webbed layer is formed between the nonwebbed diaphragm and the nonwebbed vertical inlet layer, the second webbed layer is formed between the vertical inlet layer and the nonwebbed pocketed filter layer, and the third webbed layer is formed between the nonwebbed pocketed filter layer and the aperture plate layer.

11. A method of manufacturing a printhead, comprising:

providing a nonwebbed diaphragm layer configured to deflect and eject ink from the print head during printing;

providing an aperture plate layer comprising a plurality of nozzles from which ink is ejected during printing; and providing at least one of a first webbed layer and at least one of a second webbed layer, each of the at least one first webbed layer and the at least one second webbed layer interposed between the diaphragm layer and the aperture plate layer, wherein each of the at least one first webbed layer and the at least one second webbed layers comprise a first surface having a first surface area and comprising a plurality of first openings;

a second surface opposing the first surface and comprising a plurality of second openings; and a web comprising a portion of the first surface, a portion of the second surface and a plurality of holes extending between the plurality of first and second openings, wherein each of the plurality of openings comprises a cross-sectional area, wherein a sum of the cross-sectional areas of the plurality of first openings comprises more than 85% of the first surface area, and wherein a solid surface area of the web comprises less than 15% of the first surface area.

12. The method of claim 11, further comprising providing adhesive on a portion of the first webbed layer's second surface and on a portion of the second webbed layer's first surface, and providing a first nonwebbed layer interposed between the first webbed layer and the second webbed layer.

13. The method of claim 11, wherein the web further comprises a plurality of sidewalls, each of which surrounds a respective one of the plurality of holes, wherein adjacent ones of the plurality of sidewalls are separated by at least one of a major separation distance from about from about 100 μm to about 2500 μm and a minor separation distance from about 50 μm to about 800 μm.

14. The method of claim 11, wherein at least some of the plurality of holes comprise circular cross sections or polygonal cross sections.

15. The method of claim 11, wherein the webbed layer has a thickness between the first surface and the second surface of about 25 μm to about 150 μm.

16. The method of claim 11, wherein the holes are separated by a first period in a first direction and a second period in a second direction.

17. The method of claim 16, wherein the first direction comprises a length direction of the webbed layer and the second direction comprises a width direction of the webbed layer.

18. The method of claim 11, further comprising providing a fluid channeling layer between the first webbed layer and the second webbed layer.

19. The method of claim 18, further comprising providing adhesive between at least one of the diaphragm layer and the first surface of the first webbed layer, the second surface of the first webbed layer and the fluid channeling layer, the fluid channeling layer and the first surface of the second webbed layer, or the second surface of the second webbed layer and the aperture layer.

20. The method of claim 11, further comprising:

providing a nonwebbed vertical inlet layer; and providing a nonwebbed pocketed filter layer;

wherein the at least one second webbed layer comprises a second webbed layer and a third webbed layer, and wherein the first webbed layer is formed between the nonwebbed diaphragm and the nonwebbed vertical inlet layer, the second webbed layer is formed between the vertical inlet layer and the nonwebbed pocketed filter layer, and the third webbed layer is formed between the nonwebbed pocketed filter layer and the aperture plate layer.

* * * * *